US005765385A

United States Patent [19]

Childs

[11] Patent Number: 5,765,385

[45] Date of Patent: Jun. 16, 1998

[54] SELF-COOLING BEVERAGE CONTAINER

[76] Inventor: Michael A. Childs, 2065 E. 40 North, St George, Utah 84790

[21] Appl. No.: 654,556

[22] Filed: May 29, 1996

[51] Int. Cl.[6] ..... F25D 3/08

[52] U.S. Cl. ..... 62/293; 62/371; 165/163

[58] Field of Search ..... 62/293, 294, 371; 165/DIG. 438, DIG. 441, 163

[56] References Cited

U.S. PATENT DOCUMENTS

| | | | |
|---|---|---|---|
| 1,089,277 | 3/1924 | Shepard | 62/293 |
| 1,504,732 | 8/1924 | Wilson | 165/DIG. 441 |
| 2,145,473 | 1/1939 | Billner | 62/293 |
| 2,679,732 | 6/1954 | Dotz | 62/293 |
| 3,269,141 | 8/1966 | Weiss | 62/294 |
| 3,309,890 | 3/1967 | Barnett et al. | 62/294 |
| 3,803,867 | 4/1974 | Willis | 62/294 |
| 3,987,643 | 10/1976 | Willis | 62/371 |
| 4,669,273 | 6/1987 | Fischer et al. | 62/294 |
| 4,681,006 | 7/1987 | Widhopf | 165/163 |

*Primary Examiner*—William E. Tapolcai
*Attorney, Agent, or Firm*—Thorpe, North & Western, L.L.P.

[57] ABSTRACT

A self-cooling beverage container system. The system includes a can, and an external chamber coupled to the bottom of the can for containing compressed gas therein. Helical tubing in the form of a single or double helix resides within the can. A first open end of the tubing is disposed in communication with the external chamber, and an opposing terminal end of the tubing is closed, preferably being accessible with a pull-tab as presently known in the field for opening a vessel responsive to pulling action by a user. When the terminal end of the tubing is opened it communicates with atmosphere, permitting the compressed gas to flow from the external chamber through the tubing and into atmosphere. The gas expands as it flows, thereby withdrawing heat from the surrounding beverage in which the tubing is submerged to cool the beverage.

5 Claims, 3 Drawing Sheets

SELF-COOLING BEVERAGE CONTAINER

BACKGROUND OF THE INVENTION

1. The Field of the Invention

The present invention relates generally to self-cooling containers. More particularly, it concerns a self-cooling disposable beverage can utilizing gas expansion to withdraw heat from a contained beverage.

2. The Background Art

It will be appreciated that conventional methods of cooling beverages typically involve time-consuming refrigeration of the beverage, or submersion of wet or dry ice within the beverage. Both of these cooling methods are characterized by disadvantages. Cooling by refrigeration requires additional time, as well as space within a refrigeration unit. Cooling by wet ice submersion within a beverage results in dilution of the beverage as the ice melts. Dry ice cools to −97.6° F. and as such, submerging dry ice within a beverage often results in a beverage temperature which is much too cool for consumer preference.

Several attempts have been made to fill the long-felt need for simple but effective self-cooling beverage containers. U.S. Pat. No. 5,201,183 (granted Apr. 13, 1993 to Ramos) discloses a hand-held beverage can equipped with metallic plates submerged within the beverage. A network of enclosed gas channels are formed in the plates which communicate with several capsules containing compressed gas. A user punctures the gas capsules, thereby releasing the compressed gas into the channels. A vacuum chamber draws the gas as it passes through the channels. The gas expands as it flows through the channels, thereby withdrawing heat from the beverage to cause a reduction in temperature. Provision of the plurality of gas capsules, spring-loaded pin rods for puncturing the capsules, and a vacuum chamber makes the device overly complex for its function as a disposable can.

U.S. Pat. No. 5,447,039 (granted Sep. 5, 1995 to Allison) also discloses a beverage can cooling system. The system attempts to function as a gas-charged tubing insert for insertion into a beverage can. Unfortunately, the advantages of an insert are offset by the cooling action being limited in application to the outer perimeter of the contained beverage, resulting in a non-uniform cooling effect.

U.S. Pat. No. 3,309,890 (granted Mar. 21, 1967 to Barnett et al.) teaches a refrigerated disposable container. The container utilizes a refrigerant liquid which is conveyed through a tube submerged in the container. Some of the disadvantages include that the terminal discharge end of the tube is designed to protrude through the drinking opening of the container, thus encumbering the opening during use.

OBJECTS AND SUMMARY OF THE INVENTION

It is an object of the present invention to provide a self-cooling beverage container for cooling a contained beverage relatively quickly to a predetermined temperature suitable for consumer preference.

It is another object of the present invention to provide such a beverage container which is simple in design and manufacture.

It is further object of the present invention, in accordance with one aspect thereof, to provide such a beverage container which applies cooling action to concentric portions of the beverage for a more uniform cooling effect throughout the beverage.

It is an additional object of the present invention, in accordance with one aspect thereof, to provide such a beverage container which avoids encumbering a drinking opening of the container.

The above objects and others not specifically recited are realized in a specific illustrative embodiment of a self-cooling beverage container system. The system includes a can, and an external chamber coupled to the bottom of the can for containing compressed gas therein. Helical tubing in the form of a single or double helix resides within the can. A first open end of the tubing is disposed in communication with the external chamber, and an opposing terminal end of the tubing is closed, preferably being accessible with a pull-tab as presently known in the field for opening a vessel responsive to pulling action by a user. When the terminal end of the tubing is opened it communicates with atmosphere, permitting the compressed gas to flow from the external chamber through the tubing and into atmosphere. The gas expands as it flows, thereby withdrawing heat from the surrounding beverage in which the tubing is submerged to cool the beverage.

BRIEF DESCRIPTION OF THE DRAWINGS

The above and other objects, features and advantages of the invention will become apparent from a consideration of the subsequent detailed description presented in connection with the accompanying drawings in which.

DETAILED DESCRIPTION OF PRESENTLY PREFERRED EMBODIMENTS

Figure 1:
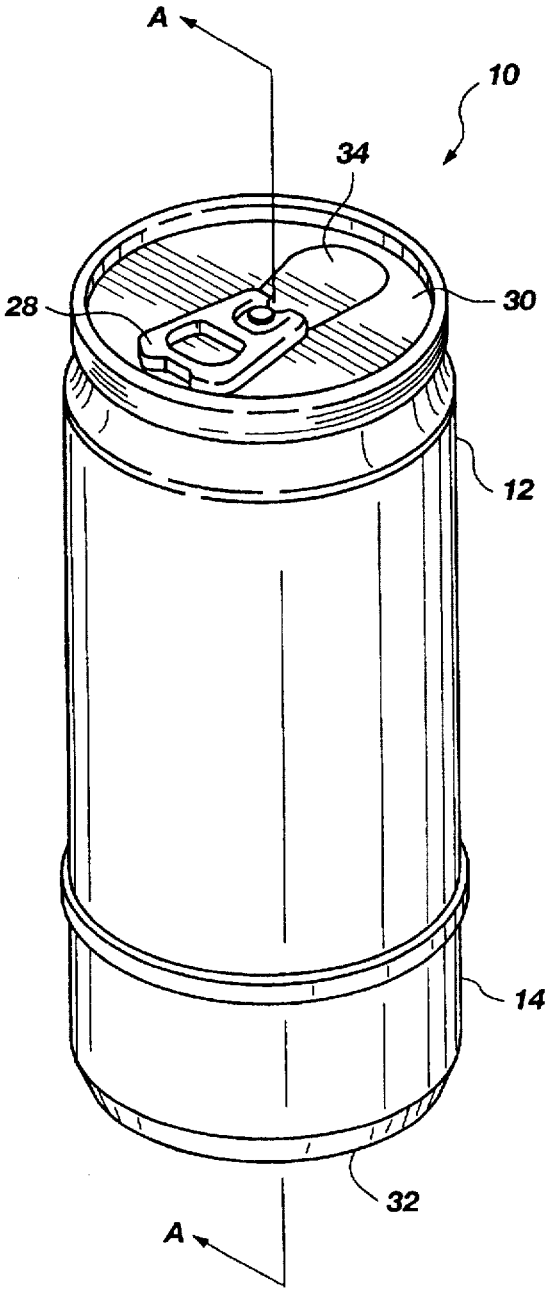
FIG. 1 is a perspective view of a self-cooling beverage container, made in accordance with the principles of the present invention.

For the purposes of promoting an understanding of the principles in accordance with the invention, reference will now be made to the embodiments illustrated in the drawings and specific language will be used to describe the same. It will nevertheless be understood that no limitation of the scope of the invention is thereby intended. Any alterations and further modifications of the illustrated apparatus, and any additional applications of the principles of the invention as illustrated herein, which would normally occur to one skilled in the relevant art and possessed of this disclosure, are to be considered within the scope of the invention claimed.

The invention comprises a method and apparatus for cooling a substance contained within a container. The preferred environment of use for the invention is contemplated to be in the field of liquid beverages. Accordingly, the invention shall be referred to herein as a self-cooling beverage container. It is to be understood, however, that the principles in accordance with the present invention are useful to cause temperature reduction in any desired substance, including, but not limited to: beverages, foodstuffs, and any edible or non-edible substance.

Figure 2:
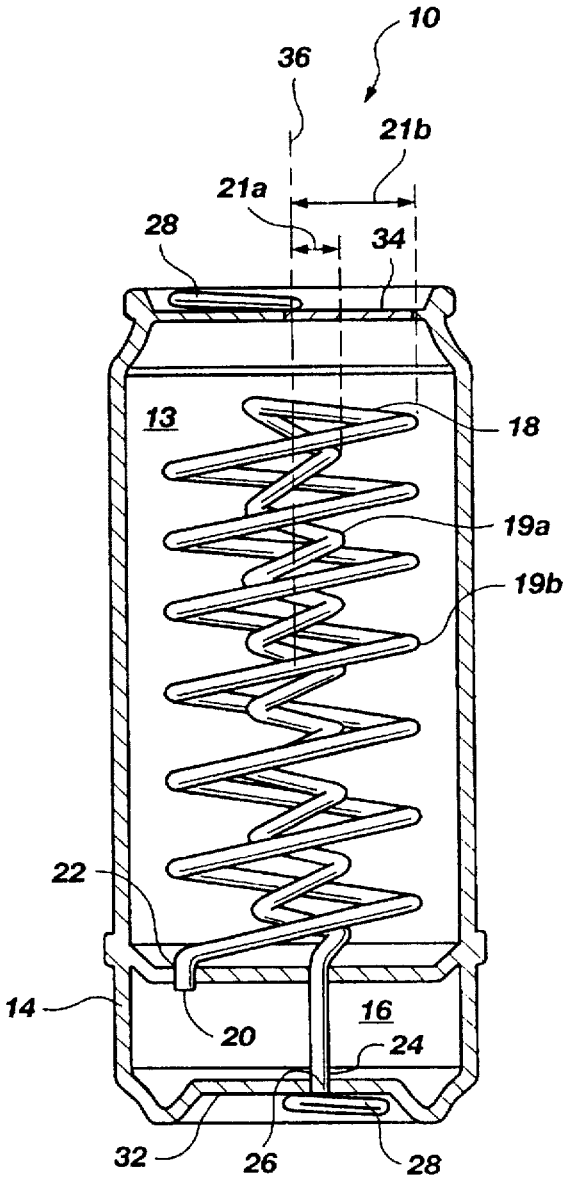
FIG. 2 is a side, cross-sectional view of the self-cooling beverage container illustrated in FIG. 1, taken along section A—A.

Referring now to FIGS. 1–2, there is shown a self-cooling beverage container, designated generally at 10. The container 10 includes a containment means 12 for containing a substance 13 therein such as a beverage. The containment means 12 preferably comprises a conventional disposable beverage can. A compression chamber 14 is coupled to the bottom of the can 12 and operates as a pressure holding means for holding a pressurized cooling agent 16 therein. Applicant contemplates compressed oxygen as a preferred medium for the pressurized cooling agent 16, although other fluids may be used for this purpose.

Tubing 18 is disposed within the can 12. The tubing 18 is preferably formed as a double helix as shown in FIG. 2. The tubing 18 includes a first open end 20 coupled to a hole 22 in the bottom of the can 12 so as to be exposed to communication with the compression chamber 14. An opposing end 24 of the tubing 18 extends through the compression chamber 14 to a closed port 26 in the bottom of the chamber 14, and is preferably closed off by a pull-tab opener 28. Alternatively, the opposing end of the tubing may terminate at the top of the can 12, as shown by closed end **24*a* in FIG. 3, wherein a pull tab opener 28*a* may be used to open the can 12 and the tube end 24*a*** substantially simultaneously.

Figure 3:
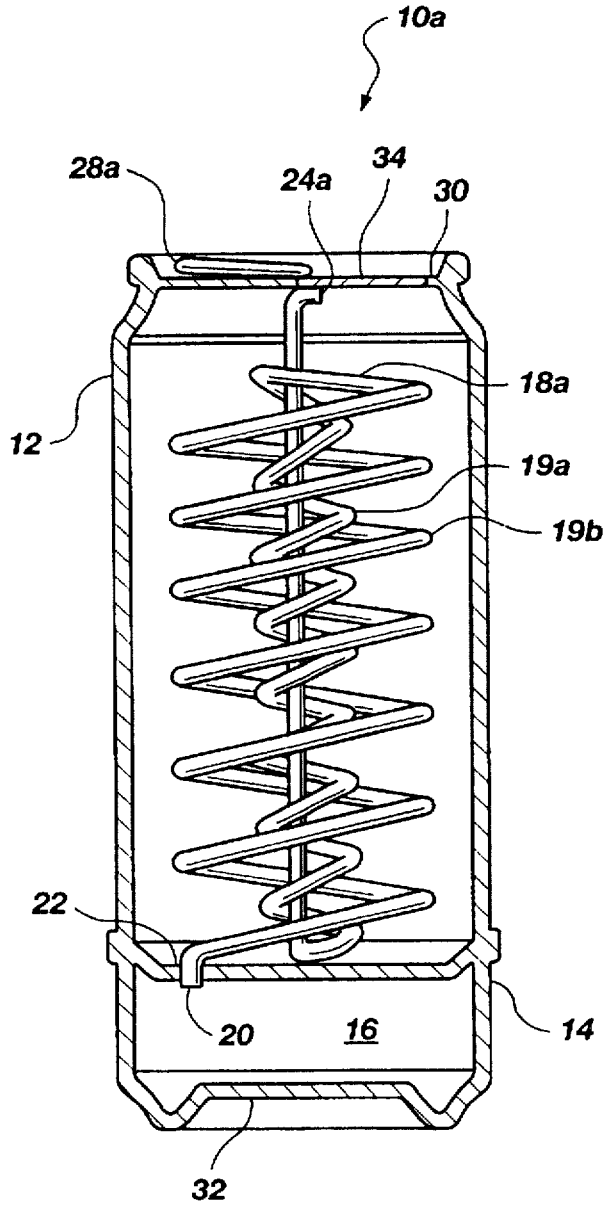
FIG. 3 is a side, cross-section view of an alternative embodiment of the self-cooling beverage container of FIG. 2.

When the pull tab 28 (FIG. 2) or **28*a* (FIG. 3) is pulled by a user, the tubing end 24 (FIG. 2) or 24*a* (FIG. 3) is opened to atmosphere, permitting the compressed gas 16 to flow into the first open end 20 of the tubing 18, through the tubing, and out through the unclosed end 24 (FIG. 2) or 24*a* (FIG. 3). It will be appreciated by those skilled in the field of thermodynamics that the gas 16 will expand as it flows through the tubing 18, and that expanding gas absorbs heat from its surroundings. The result is that heat is removed from the contained beverage 13 as the compressed gas 16 flows through the tubing 18**, so that the beverage is cooled.

The pull-tab opener 28 constitutes a means for discharging the gas 16 from the can 12. The pull-tab opener 28 may also be defined as a means for discharging the gas 16 from a lower surface 32 of the container 10 and in a direction away from a face of the consumer (not shown) when the consumer is ingesting the beverage 13 from the can 12. As will be readily apparent to one of ordinary skill in the art by inspecting FIG. 2, one may drink the beverage 13 from the can 12 by tilting the can 12 as desired, without the need to completely invert the can 12, to thereby tip the orifice 34 toward his or her mouth.

It will be appreciated by inspection of FIGS. 1–3 that the tubing 18 operates as an advancement means for (i) advancing the compressed gas 16 along a first movement path through an inner core portion of the beverage 13 to thereby reduce temperature of said inner core portion, and (ii) advancing the compressed gas 16 through a second, surrounding portion of the beverage 13 along a second movement path encircling said inner core portion to thereby reduce temperature of said second, surrounding portion of the beverage. The inner helix **19*a* of the tubing 18 defines the first movement path, and the outer helix 19*b*** defines the second movement path.

In order to accomplish some of the purposes set forth above in accordance with the present invention, including the objectives of applying cooling action to concentric portions of a beverage in a manner to produce a more uniform cooling effect throughout the beverage, and cooling a contained beverage relatively quickly, it is preferred that the outer helix **19*b* reside sufficiently spaced apart from the inner helix 19*a* (as shown most clearly in FIG. 2**) for the accomplishment of these purposes.

As also shown in FIG. 2, the inner helix **19*a* defines a first movement path for passage of the gas 16**, said first movement path being characterized by an absence of any non-liquid structures extending through helices thereof.

It is to be understood that the tubing 18 may comprise shapes and configurations other than helices. The tubing 18 preferably comprises one or two helices, each helix having at least four substantially helical coils as in FIG. 2. In the case of inner and outer helices **19*a* and 19*b* as in FIG. 2, it is preferred that the inner helix 19*a* be confined within an inner core portion of the beverage 13, and that the outer helix 19*b* be confined within a second, surrounding portion of the beverage, as illustrated in FIG. 2. It is also preferred that the outer helix 18*b* itself surround the inner helix 19*a*, although the tubing 18 may of course be configured into a plurality of non-concentric helices if desired. It is further preferred that the first helix (inner helix 19*a* in FIG. 2) define a first movement path which merges into a second movement path defined by a second helix (outer helix 18*b* in FIG. 2) to form of a single, continuous movement path for the gas 16**.

The container 10 comprises an upper surface 30 and a lower surface 32. The upper surface 30 has a closed orifice 34 which can be opened with a pull-tab opener 28. The pull-tab opener 28 (or **28*a* in FIG. 3) constitutes a means for unclosing the orifice 34 to enable a consumer to ingest the beverage 13** from the orifice.

It is preferred that the terminal end 24 of the tubing 18 not protrude from the drinking orifice 34. This is especially important with respect to the embodiment of FIG. 3 wherein the terminal end **24*a* preferably terminates at the upper surface 30 of the container 10*a*. The container 10*a* would preferably be designed such that opening the pull-tab opener 28*a* would expose the open end 24*a* which is substantially co-terminus an edge of the drinking orifice 34, in any case such that the end 24*a* does not protrude through the drinking orifice 34. As such, the pull-tab opener 28*a* would constitute a manually-operable opening means coupled to the can 12 for substantially simultaneously opening the orifice 34 of the upper surface 30 and opening the closed terminal end 24*a* of the hollow tubing 18*a***.

In accordance with the above description, a preferred method of cooling a substance contained in a container comprises the steps of:

(a) advancing a cooling agent along a first movement path through an inner core portion of the substance to thereby reduce temperature of said inner core portion; and (b) advancing a cooling agent through a second, surrounding portion of the substance along a second movement path encircling said inner core portion to thereby reduce temperature of said second, surrounding portion of the substance.

It will be appreciated that the can 12 defines a central axis 36 and that the inner and outer helices **19*a* and 19*b* extend in an axial direction with respect to the axis 36. It will be appreciated that the axis 36 defines two opposing axial directions, and that the helices 19*a* and 19*b* extend in several directions, including axial directions, because of their steady, winding progression in the direction of the axis 36**.

As shown most clearly in FIG. 2, the inner and outer helices **19*a* and 19*b* reside first and second radial distances 21*a* and 21*b* from the axis 36 of the container 10, respectively. The second radial distance 21*b* is larger than the first radial distance 21*a*. Alternatively, the tubing 18** may be configured into helices which reside side-by-side instead of in the co-axial orientation depicted in FIG. 2. In this latter alternative, the helices may reside either equidistantly or differentially spaced from the axis 36.

Figure 4:
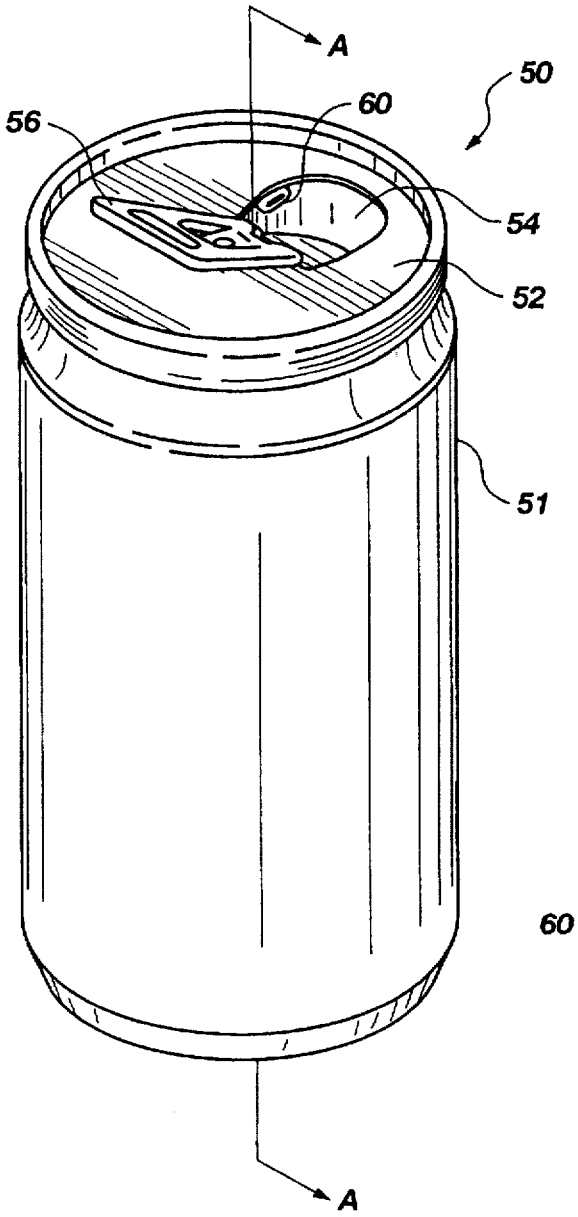
FIG. 4 is a perspective view of another alternative embodiment of a self-cooling beverage container, made in accordance with the principles of the present invention.
Figure 5:
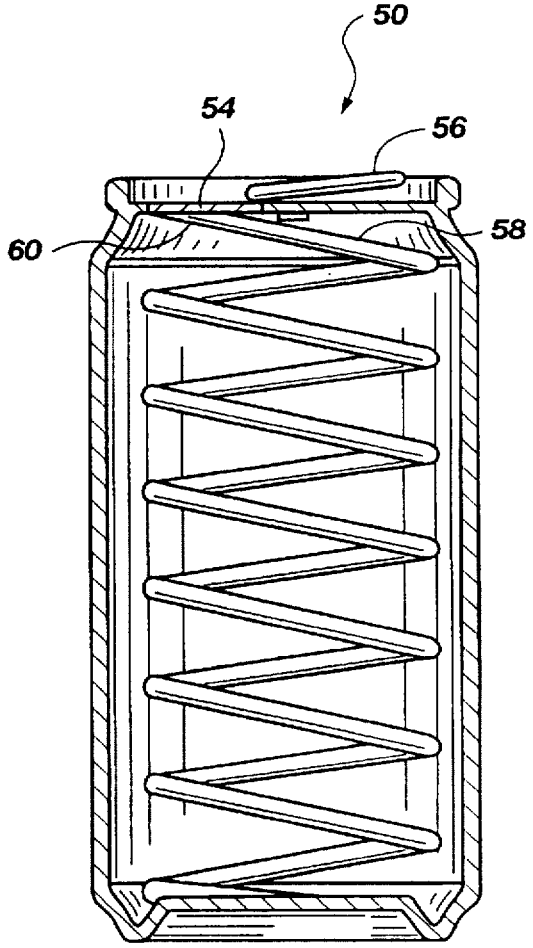
FIG. 5 is a side, cross-sectional view of the self-cooling beverage container illustrated in FIG. 4, taken along section A—A.

Referring now to FIGS. 4–5, a container is designated generally at 50. The container 50 comprises a can 51 having a top 52 in which is formed a drinking orifice 54 which can be opened with a pull-tab opener 56. The container 50 includes tubing 58, preferably formed as a helix. The tubing 58 is gas charged, preferably with compressed oxygen, and a terminal end 60 of the tubing terminates inside the can 51 without extending through the drinking orifice 54 even after the orifice is opened. The container 50 is preferably designed such that the pull-tab opener 56 operates to open both the orifice 54 and the terminal end 60 substantially simultaneously.

It will be appreciated that the invention may be constructed with or without a separate compression chamber. For example, the embodiments shown in FIGS. 1–3 include compression chamber 14; the embodiment shown in FIGS. 4–5 does not include a separate compression chamber but simply relies upon compressed gas within the tubing 58 which expands when the terminal end 60 is opened. A larger volume of compressed gas could be utilized in the embodiment of FIGS. 4–5 by modifying that embodiment to include a compression chamber such as the chamber 14 in FIGS. 1–3. Conversely, the embodiments of FIGS. 1–3 could also be modified to eliminate the compression chamber 14, leaving only a gas-charged helical tubing 18 (FIGS. 1–2) or 18*a* (FIG. 3) if such would provide a sufficient amount compressed gas for the purpose intended.

The embodiment of FIGS. 4–5 is thus similar to those of FIGS. 1–3. Some of the differences include that the tubing 58 forms only a single helix and terminates at the top 52 of the can 51 in terminal end 60. The helical tubing 58 is configured and arranged to prevent the terminal end 60 from extending through the drinking orifice 54 when the orifice is opened, such as by attachment of the terminal end 60 to the interior surface of the top 52. The pull-tab opener 56 preferably constitutes a manually-operable opening means coupled to the can 51 for substantially simultaneously opening the orifice 54 and opening the closed terminal end 60 of the hollow tubing 58.

The present invention could be fabricated by modifying a pre-existing manufacturing process for making conventional beverage cans. It will be appreciated that the can 12 of FIGS. 1–2 could be fabricated in the same way as presently known in the field, and the remaining elements of the invention could be added as shop step modifications of the existing manufacturing process. Accordingly, one preferred method of manufacturing a self-cooling beverage container comprises the steps of:

(a) selecting a pre-fabricated container having a bottom surface and an upper opening;

(b) forming a hole in the bottom of the container;

(c) inserting a tube through the upper opening and into the container and placing a first open end of the tube into communication with the hole in the bottom of the container;

(d) attaching to the bottom of the container an external pressure holding means for holding a pressurized cooling agent therein, such that an interior of the pressure holding means is disposed in communication with the first open end of the tube; and (e) hermetically sealing an interior of the tube and the interior of the pressure holding means from atmosphere, and attaching to the tube a means for opening the tube to atmosphere to enable pressurized cooling agent contained in the pressure holding means to pass through the tube and into atmosphere.

It is to be understood that the container 50 could be used to cool virtually any substance contained in the can 51. It is also to be understood that some embodiments in accordance with the principles of the present invention need not require the double-helix configuration of tubing 19 or the compression chamber 14 of FIG. 2.

It is to be understood that the above-described arrangements are only illustrative of the application of the principles of the present invention. Numerous modifications and alternative arrangements may be devised by those skilled in the art without departing from the spirit and scope of the present invention. The appended claims are intended to cover such modifications and arrangements which may be achieved by those having ordinary skill in the art.

What is claimed is:

1. A self-cooling beverage container comprising:

containment means for containing a beverage, said containment means defining a central axis and having a closed port and an upper portion and a lower portion;

pressure holding means for holding a pressurized cooling agent therein;

a one-piece, unitary tube having a first open end disposed in communication with the pressure holding means and extending in an axial direction along a first substantially helical movement path through an inner core section of the containment means and further extending along a second substantially helical movement path encircling said inner core section, such that said tube defines a double-helix, said helical tube having a closed terminal end disposed in the lower portion of the containment means, said helical tube being configured and arranged to prevent said terminal end from extending through the port of the containment means when said port is open, wherein said first continuous movement path of the tube extends around the central axis of the containment means without coinciding with any portion of the central axis of the containment means; and manually-operable opening means coupled to the containment means for (i) opening the closed port of said containment means and (ii) opening the closed terminal end of the helical tube, without the need to invert the containment means.

2. The container as defined in claim 1, wherein the containment means comprises an upper surface in which the closed port is formed;

wherein the manually-operable opening means includes means for substantially simultaneously opening the port in the upper surface and opening the closed terminal end of the helical tube.

3. The container as defined in claim 1, wherein the unitary tube comprises at least four helical coils extending along the first substantially helical movement path.

4. The container as defined in claim 1, wherein the containment means comprises an upper surface in which the closed port is formed.

5. The container as defined in claim 1, wherein the pressure holding means further comprises a means for holding a non-liquid cooling agent therein.

* * * * *